US011357693B2

(12) United States Patent
Koenig et al.

(10) Patent No.: US 11,357,693 B2
(45) Date of Patent: Jun. 14, 2022

(54) RELIEF SYSTEM FOR AT LEAST PARTIALLY RELIEVING THE BODY WEIGHT OF A PERSON

(71) Applicant: REACTIVE ROBOTICS GMBH, Munich (DE)

(72) Inventors: Alexander Koenig, Munich (DE); Ramona Susanna Schlaefer, Munich (DE); Manfred Koestlmeier, Putzbrunn (DE)

(73) Assignee: Reactive Robotics GmbH, Munich (DE)

( * ) Notice: Subject to any disclaimer, the term of this patent is extended or adjusted under 35 U.S.C. 154(b) by 15 days.

(21) Appl. No.: 16/966,550

(22) PCT Filed: Jan. 28, 2019

(86) PCT No.: PCT/DE2019/100089
§ 371 (c)(1),
(2) Date: Jul. 31, 2020

(87) PCT Pub. No.: WO2019/149317
PCT Pub. Date: Aug. 8, 2019

(65) Prior Publication Data

US 2021/0038464 A1 Feb. 11, 2021

(30) Foreign Application Priority Data

Jan. 31, 2018 (DE) ..... 10 2018 102 179.8

(51) Int. Cl.
*A61H 3/00* (2006.01)
*A63B 21/00* (2006.01)
(Continued)

(52) U.S. Cl.
CPC ..... *A61H 3/008* (2013.01); *A61G 7/005* (2013.01); *A63B 21/4034* (2015.10);
(Continued)

(58) Field of Classification Search
CPC ..... A61H 3/008; A61H 2201/0192; A61H 2201/149; A61H 2201/163;
(Continued)

(56) References Cited

U.S. PATENT DOCUMENTS 3,408,067 A * 10/1968 Armstrong ..... A63B 22/02 472/91
4,204,673 A * 5/1980 Speer, Sr. ..... A63B 22/0292 601/40
(Continued)

FOREIGN PATENT DOCUMENTS

DE 3912657 * 10/1990
DE 3912657 A1 10/1990
(Continued)

*Primary Examiner* — Garrett K Atkinson
(74) *Attorney, Agent, or Firm* — Laurence A. Greenberg; Werner H. Stemer; Ralph E. Locher

(57) ABSTRACT

A relief system for at least partially relieving the body weight of a person includes at least one first fastening device for fastening a first end of a first support device and at least one second fastening device for fastening a second end of the first support device which are formed on a cuff, such that an equally distributed tensile force is exerted on the cuff at the first fastening device and second fastening device when the first support device is guided through a guide device during a movement of the cuff when loaded by at least part of the body weight of the person. This advantageously permits a simple connection in particular of a bedridden patient to the relief system, without the patient first having to be moved, without other medical/therapeutic devices being disturbed, and without limiting the patient's stepping/walking movement.

22 Claims, 5 Drawing Sheets

(51) Int. Cl.
*A61G 7/005* (2006.01)
*A63B 22/00* (2006.01)
*A63B 69/00* (2006.01)

(52) U.S. Cl.
CPC ..... *A63B 22/00* (2013.01); *A63B 69/0064* (2013.01); *A61H 2201/0192* (2013.01); *A61H 2201/149* (2013.01); *A61H 2201/163* (2013.01); *A61H 2201/1642* (2013.01); *A61H 2201/5061* (2013.01); *A61H 2203/0487* (2013.01); *A63B 69/0028* (2013.01); *A63B 2022/0092* (2013.01); *A63B 2220/52* (2013.01); *A63B 2225/093* (2013.01)

(58) Field of Classification Search
CPC .... A61H 2201/1642; A61H 2201/5061; A61H 2203/0487; A61H 2201/0103; A61H 2201/1215; A61H 1/0222; A61H 1/0229; A61H 1/005; A61H 1/0266; A61H 2203/0456; A61H 2201/0142; A61H 2201/1621; A63B 21/4034; A63B 22/00; A63B 69/0064; A63B 69/0028; A63B 2022/0092; A63B 2220/52; A63B 2225/093; A63B 21/00178; A63B 21/4011; A63B 21/4001; A63B 21/002; A63B 21/0058; A63B 21/153; A63B 2220/51; A63B 2225/62; A63B 21/00069; A61G 7/005
See application file for complete search history.

(56) References Cited

U.S. PATENT DOCUMENTS 4,423,864 A * 1/1984 Wiik ..... A63B 22/203 472/91
4,515,152 A 5/1985 Teeter
4,733,858 A * 3/1988 Lan ..... A63B 21/4047 482/53
5,203,754 A 4/1993 Maclean
5,286,242 A * 2/1994 Johnston ..... A63B 23/03575 482/125
5,314,390 A * 5/1994 Westing ..... A63B 21/4034 601/36
5,830,162 A * 11/1998 Giovannetti ..... A61B 5/1038 482/69
6,880,487 B2 * 4/2005 Reinkensmeyer ... A01K 15/027 119/728
7,125,388 B1 * 10/2006 Reinkensmeyer ..... A63B 69/0064 601/5
7,381,163 B2 * 6/2008 Gordon ..... A63B 22/02 482/69
7,621,850 B2 * 11/2009 Piaget ..... A63B 21/154 482/54
8,002,674 B2 * 8/2011 Piaget ..... A63B 23/0429 482/52
8,550,962 B2 * 10/2013 Piaget ..... A63B 22/04 482/52
8,608,479 B2 * 12/2013 Liu ..... A61H 3/04 434/255
10,265,565 B2 * 4/2019 Jue ..... A63B 69/0064
10,406,059 B2 * 9/2019 Agrawal ..... A61H 1/0262
10,925,796 B2 * 2/2021 Fukunaga ..... A61H 1/0266
11,103,415 B2 * 8/2021 Izu ..... A61H 3/008
11,141,343 B2 * 10/2021 Sugata ..... A63B 21/4035
2005/0101448 A1 * 5/2005 He ..... A61H 1/0255 482/69
2011/0275043 A1 * 11/2011 Liu ..... A61H 3/04 434/247
2012/0197168 A1 * 8/2012 Agrawal ..... A63B 21/4009 602/19
2014/0350437 A1 11/2014 Ram et al.
2017/0027803 A1 * 2/2017 Agrawal ..... A61B 5/1122
2017/0035638 A1 2/2017 Koenig
2017/0246069 A1 8/2017 Kalinowski

FOREIGN PATENT DOCUMENTS

DE 19805164 C1 5/1999
DE 102007050575 A1 4/2009
DE 102014004997 A1 10/2015
DE 102018102107 A1 8/2019
EP 0094582 A2 11/1983
EP 1595522 A1 11/2005
EP 3131516 A1 2/2017
JP S61185453 U 11/1986

* cited by examiner

RELIEF SYSTEM FOR AT LEAST PARTIALLY RELIEVING THE BODY WEIGHT OF A PERSON

BACKGROUND OF THE INVENTION

Field of the Invention

The present invention relates to a relief system for at least partially relieving the body weight of a person, at least comprising: a suspension, a cuff for receiving at least part of an outer extremity of the person, a first support means for operatively connecting the cuff to the suspension, and a guide means arranged on the suspension for guiding the first support part.

In the context of rehabilitation of bedridden patients, and also during targeted walking and/or running training, it may be advantageous to control the weight load acting on the joints, bones, tendons and/or ligaments, etc., of a person who is training, and to reduce this weight load in relation to a load with the full body weight.

For this purpose, various systems for relieving the body weight have been disclosed in the prior art.

For example, DE 10 2007 050 575 A1 discloses an apparatus for securing patients and for relieving the weight of handicapped patients, in particular stroke patients, which apparatus can be used in treadmill training. The disclosed apparatus stands on the floor, has a frame-like shape and extends across a treadmill, such that rope suspensions can be fastened, with maximum utilization of the ceiling height by two separate rope suspensions for the patient to the left and right alongside the head at the shoulders. By providing two separate rope suspensions, which are subsequently joined together to a central main attachment, wherein the main attachment and the joining together are in turn located laterally alongside the patient and not above the head of the patient, the apparatus has a particularly small overall height.

DE 198 05 164 C1 discloses a training apparatus for the human gait, which apparatus can be used both for gait rehabilitation and also as a training apparatus. It is distinguished by, among other things, a strap system which is controlled by the center of gravity and which secures the patient.

Finally, DE 10 2014 004 997 A1 discloses a body weight relief apparatus for stabilizing the trunk and securing against falls, particularly for treadmill ergometer applications in ergometry, therapy, rehabilitation and running/sprinting training. It is distinguished by a fall prevention means with automatic switching off of the treadmill and with automatic lifting/uprighting of the patient/athlete in the event of a fall.

A common aspect of all the body weight relief systems mentioned is that the interaction between the respective apparatus and the user takes place via harnesses and/or straps, which have to be arranged on the upper body, the waist and/or the groin region of the user, in order to hold the user in a secure and stable manner. Particularly in the rehabilitation of seriously or critically ill patients who, for example on account of loss of consciousness, are unable to apply such harnesses/straps themselves, the known systems always cause healthcare personnel the problem of having to connect the patient to the respective apparatus from a lying position, which makes it necessary to lift the whole upper body of the patient. Moreover, seriously ill patients in particular are often connected to many other diagnostic and/or therapeutic medical devices, for example ECGs, catheters and the like, which cannot be disconnected during the rehabilitation measures and which must also not be interfered with and/or impeded by the connection to a body weight relief system.

Reference is also made to USA 2017/0246069 A1 and to U.S. Pat. No. 5,203,754 A1.

SUMMARY OF THE INVENTION

Proceeding from the above, the object of the present invention is to make available a body weight relief system which is improved in relation to the prior art and which makes it possible, especially for a third party, to easily establish a connection between a user, in particular a seriously ill and bedridden patient, and the relief system. The body weight relief system is also intended to be designed in such a way as to avoid interfering with or impeding other medical devices connected to the patient, and at the same time to permit an unrestricted stepping/walking movement of the user.

This object is achieved by a relief system for at least partially relieving the body weight of a person, at least comprising a suspension, a cuff for receiving at least part of an outer extremity of the person, first support means for operatively connecting the cuff to the suspension, and guide means arranged on the suspension for guiding the first support means.

Compared to relief systems of the type in question, a relief system according to the invention is characterized in that the cuff is designed as a thigh cuff for receiving a thigh of the person, and that at least one first fastening means for fastening a first end of the first support means and at least one second fastening means for fastening a second end of the first support means are formed on the cuff, wherein the support means runs via the guide means, such that an equally distributed tensile force is exerted on the cuff at the first fastening means and second fastening means when the first support means is guided through the guide means during a movement of the cuff when loaded by at least part of the body weight of the person.

The relief system according to the invention advantageously permits comfortable movement of the cuff, with low resistance, and therefore of an outer extremity, in particular a leg, at the same time with constant relief of at least part of the body weight of the person who is training. Through the possibility of receiving at least parts of extremities of a person by means of the cuff of the relief system, it is advantageously possible, when connecting the person to the relief system before the start of the training or rehabilitation exercises, to avoid having to reposition the person. Particularly when using the relief system in the context of rehabilitation exercises by a bedridden patient in an intensive care unit, the fact that at least part of an outer extremity of the person is received by the cuff advantageously ensures compatibility with medical/therapeutic devices, for example catheters and/or diagnostic sensors, which are often arranged on the torso and/or in the groin region of the person. Finally, the cuff can be designed in the manner described in the parallel application 10 2018 102 107.1 which is filed today by the applicant and to which reference is made in full.

Further advantageous embodiments and developments which can be used individually or in combination with one another are the subject matter of the dependent claims.

In a preferred embodiment of the invention, at least one third fastening means can be formed on the cuff for fastening a first end of a second support means whose second end is connected to the suspension, such that a variable tensile force is exerted on the cuff at the third fastening means when the second support means is guided through the guide means during a movement of the cuff when loaded by at least part of the body weight of the person. The three-point suspension ensured in this way means that the force acting on the cuff, in particular at the zero point of the movement, i.e. with the suspended extremity of the person extended and approximately straight, is advantageously distributed uniformly to the cuff, thereby advantageously increasing the stability of the relief system, in particular as regards lateral tilting of the cuff.

In a further embodiment of the invention, it has proven expedient that, on a closed cuff, the fastening means can be arranged variably, such that, in the case of two fastening means, these are arranged at an angle of 180° to each other, and, in the case of three fastening means, these are arranged at an angle of 120° to each other. Fastening means that are able to be arranged variably advantageously allow the positions of the fastening means on the cuff to be adapted to the diameter of the extremity received by the cuff and in this way advantageously lead to a uniformly applied, i.e. equally distributed, tensile force on the cuff or on the extremity received by the latter.

In a further embodiment of the invention, the guide means can have at least one slide eyelet or a deflection roller to which the first support means is operatively connected. A guide means designed as a deflection roller advantageously permits particularly smooth running of the first support means. A slide eyelet is a particularly cost-effective alternative to this.

In a preferred embodiment, the cuff can moreover be designed as a thigh cuff for receiving a thigh of a person. A cuff designed as a thigh cuff advantageously allows the person to be received directly at the thigh and thereby avoids further holding and/or stabilizing means that could impede the movement of the person. Moreover, a thigh cuff in particular advantageously avoids interference with other medical/therapeutic devices such as catheters, in particular with inguinal catheters. In contrast to a waist strap or upper body jacket for example, a thigh cuff is advantageously fitted in place without the person being repositioned, wherein the user, in particular the physiotherapist, in each case only has to move a leg, which is relatively light compared to a person's trunk.

Moreover, an embodiment of the relief system has proven expedient in which the suspension is part of a head end of a hospital bed, in particular of a hospital bed that can be raised to a vertical position. A suspension designed as part of a head end of a hospital bed, in particular of a hospital bed that can be raised to a vertical position, advantageously permits simple and at the same time stable fastening of the relief system and advantageously saves on further structural parts, e.g. additional frames.

In a further preferred embodiment of the invention, the relief system can have a means for longitudinal displacement, which is designed to displace the suspension along a longitudinal direction, in particular of a hospital bed. With the aid of such a means for longitudinal displacement, it is possible, when using the relief system together with a stationary base plate or with a treadmill or the like, to relieve at least part of the body weight of the person by pulling, i.e. by a longitudinal displacement of the suspension along a longitudinal direction, in particular of a hospital bed. Particularly in the case of persons who are physically quite large and/or strong, a relief system configured in this way can advantageously facilitate individual adaptation to the respective user, without having to move the actual person in the hospital bed.

It has also proven expedient if an additional means is provided for at least partially taking up further weight of the person. The additional means can be designed as a base plate arranged at the foot end of the hospital bed or, particularly preferably, as a foot module of a rehabilitation mechanism that permits step movements. Particularly in the case of intensive care patients, who should be moved (moved lengthwise) as little as possible in their bed, an additional means for at least partially taking up further weight of the person permits relief by displacement of a base plate/foot module along a longitudinal direction of the hospital bed, wherein the person, in this case in particular the intensive care patient, can remain in position as regards a longitudinal movement.

Moreover, an embodiment of the invention is preferred in which a sensor can be provided for measuring a weight force on the person, in particular for measuring the force acting on the outer extremities, which sensor provides control data for the control of a means for longitudinal displacement, of an additional means for at least partially taking up further weight of the person, and/or of a verticalization mechanism of a hospital bed. A sensor-controlled relief system of this kind advantageously allows the weight force acting on the extremities of the person to be set automatically according to the sensor data actually measured.

According to the invention, an embodiment of the relief system is preferred in which, in particular at the head end of a hospital bed, two suspensions are arranged spaced apart from each other, wherein a cuff can be operatively connected to each suspension via a first support means. A relief system configured in this way with two suspensions advantageously permits uniform relief on both sides of the body and is particularly suitable for the performance of (automated) walking therapy and/or mobilization, in particular using a foot module of a rehabilitation mechanism arranged, for example, on the hospital bed.

Moreover, in a further embodiment, the first support means and/or the second support means can be configured as a band, belt, strap and/or a chain.

Particularly preferably, the first support means and/or the second support means can be formed from a disinfectable plastic, in particular from polyurethane, or can be provided with a disinfectable coating, in particular of polyurethane. Support means made from a disinfectable plastic, or those provided with a disinfectable coating, advantageously permit time-efficient and thorough cleaning of the support means and, particularly when used in the intensive care unit of a hospital, meet the stringent hygiene requirements in place there.

It has moreover proven expedient if the first support means and/or the second support means are designed to be longitudinally adjustable at least at one end. The support means can thus be advantageously adapted easily and quickly to the height of the person training. Particularly when used at a rehabilitation center, in which various users use the same relief system in quick succession, the "changeover" time for adaptation to the next user is advantageously shortened.

Finally, an embodiment of the invention is preferred in which a holding system is provided for the upper body and/or the waist of a person. A holding system can advantageously improve the stabilization during the movement of the person who is training, particularly if only one cuff is provided on the relief system.

The present invention makes available a relief system which is improved in relation to the prior art and which at least partially relives the body weight of a person and makes it possible, especially for a third party, to easily connect a person, in particular a seriously ill and bedridden patient, to the relief system before the start of the training or the rehabilitation exercises, advantageously without repositioning of the person. Furthermore, particularly when using the relief system in the context of rehabilitation exercises by a bedridden patient in an intensive care unit, the fact that at least part of an outer extremity of the person is received by the cuff advantageously ensures compatibility with medical/therapeutic devices, for example catheters and/or diagnostic sensors, which are often arranged on the torso and/or in the groin region of the person. Moreover, the present invention advantageously permits the performance of rehabilitation and/or mobilization exercises with at least partial relief of the body weight of the person, without impeding the stepping/walking movement of said person. It is of course therefore also suitable for use in traditional rehabilitation apparatuses and/or sports apparatuses for non-bedridden patients.

Additional details and further advantages of the invention are described below on the basis of preferred illustrative embodiments, to which the present invention is not limited however, and in conjunction with the accompanying schematic drawing.

DETAILED DESCRIPTION OF THE INVENTION

In the following description of preferred embodiments of the present invention, identical reference signs designate identical or comparable components.

Figure 1:
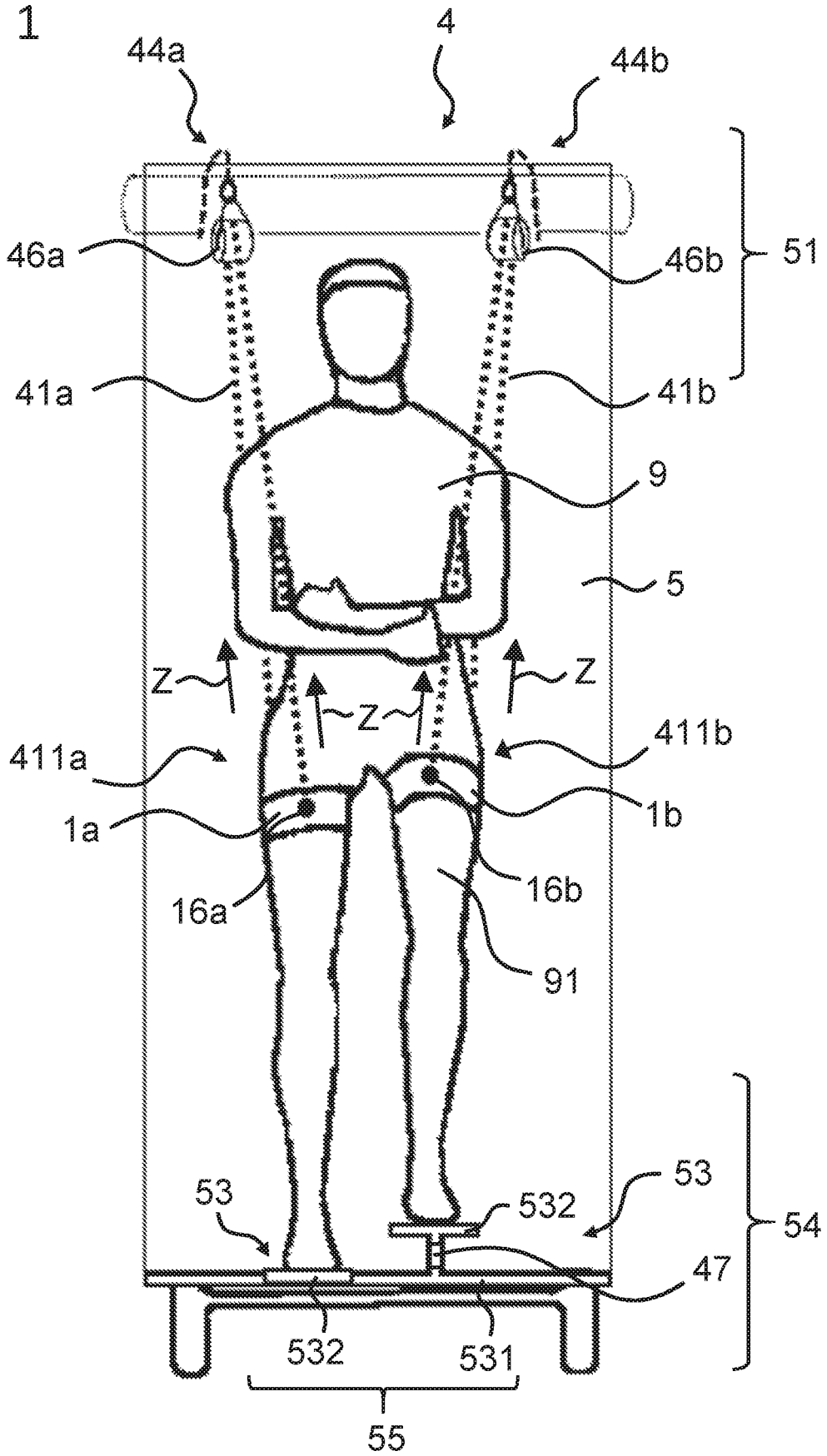
FIG. 1 shows a front view of an embodiment of a relief system according to the invention with two suspensions spaced apart from each other and fastened to the head end of a hospital bed.

FIG. 1 shows a front view of an embodiment of a relief system 4 according to the invention with two suspensions 44*a* and 44*b* spaced apart from each other and fastened to the head end 51 of a hospital bed 5. In this embodiment, a cuff 1*a*, 1*b* is operatively connected to a respective suspension 44*a*, 44*b* via a first support means 41*a*, 41*b*. The suspensions 44*a*, 44*b* can be designed separately and arranged, as shown, at the head end 51 of a hospital bed 5, or they can also be part of a head end 51 of a hospital bed 5. The hospital bed 5 is preferably designed to be able to be raised vertically, such that, by movement of the hospital bed 5 from the horizontal, a person 9 lying on it can be pivoted from the horizontal position all the way to a completely upright position.

The cuffs 1*a* and 1*b* can preferably be designed in the manner described in the parallel application DE 10 2018 102 107.1 filed today by the applicant, for which reason reference is made in full to this parallel application in order to avoid repetition, and they serve to receive at least part of an outer extremity of a person 9 and, as shown here, can be designed as thigh cuffs for receiving a thigh 91 of the person 9. At least one guide means 46*a*, 46*b* for guiding the first support means 41*a*, 41*b* is arranged respectively on the suspensions 44*a*, 44*b*, wherein the one or more guide means 46*a*, 46*b* preferably have at least one slide eyelet or, as here, a deflection roller 461, to which the first support means 41*a*, 41*b* are operatively connected. The one or more support means 41*a*, 41*b* can be designed as a band, belt, strap and/or a chain. They are preferably formed from a disinfectable plastic, in particular from polyurethane, or are provided with a disinfectable coating, in particular of polyurethane, in order to make them easier to clean.

To perform rehabilitation exercises or training, a person 9 can now be connected to the relief system 4, for example, via one or both cuffs 1*a*, 1*b*. For this purpose, the cuffs 1*a*, 1*b*, designed here as thigh cuffs, can advantageously be arranged on at least part of an outer extremity, here on a thigh 91, by a third party, without having to lift the upper body 92 and/or waist 93 of the person 9, and can thus secure the person 9. If the hospital bed 5 that can be raised vertically is now pivoted from a horizontal position to a vertical position, the downward force acting on the person 9 increases as the pivoting angle increases.

As can be seen from FIG. 1, an additional means 53 for at least partially taking up further weight of the person, and in the form of a base plate 531 or of a foot module 532 of a rehabilitation mechanism 55, can be arranged at the foot end 54 of the hospital bed 5.

If the person 9 is operatively connected to the additional means 53 for at least partially taking up further weight of the person, the weight load on the outer extremities, in particular on the legs, of the person 9 would increase continuously as the pivoting angle increases and, consequently, as the downward force increases.

However, since at least one first fastening means 16*a*, 16*b* for fastening a first end 411*a*, 411*b* of the first support means 41*a*, 41*b* and at least one second fastening means 17*a*, 17*b* for fastening a second end 412*a*, 412*b* of the first support means 41*a*, 41*b* are formed on the cuffs 1*a*, 1*b*, such that an equally distributed tensile force Z is exerted on the cuffs 1*a*, 1*b* at the first fastening means 16*a*, 16*b* and second fastening means 17*a*, 17*b* when the first support means 41*a*, 41*b* is guided through the guide means 46*a*, 46*b* during a movement B of the cuffs 1*a*, 1*b* when loaded by at least part of the body weight of the person, at least part of the body weight of the person 9 is taken up.

Depending on the severity of the person's condition and/or on the form of rehabilitation and/or mobilization exercises that are to be performed, the person 9 can be received exclusively by the one or more cuffs 1*a*, 1*b*, or, alternatively, a holding system 6 for the upper body 92 and/or the waist 93 of the person can be provided, in order to additionally stabilize the person.

Figure 2:
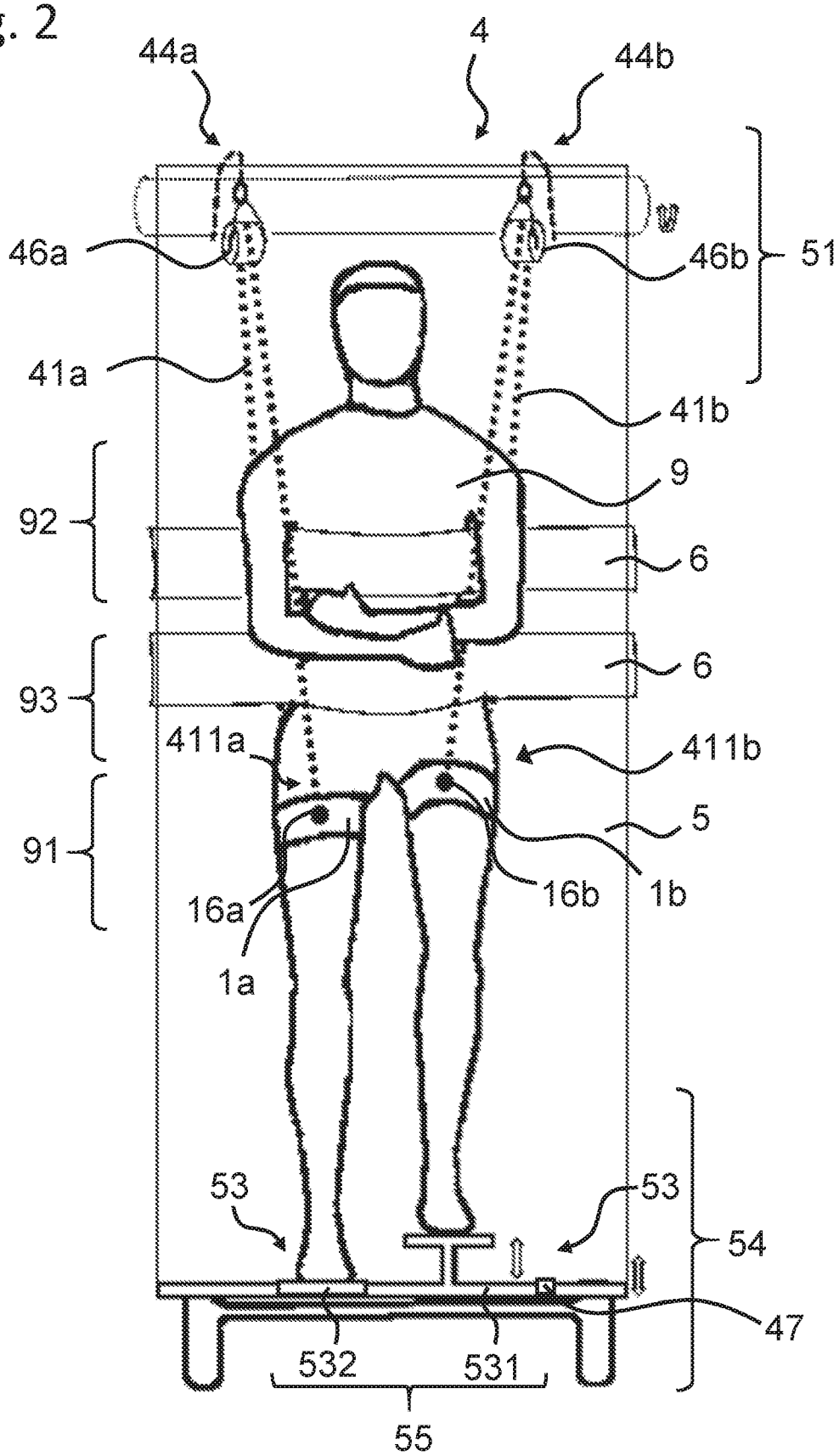
FIG. 2 shows the relief system from FIG. 1, with a holding system for the upper body and/or the waist of a person.

FIG. 2 shows the relief system 4 from FIG. 1 with a holding system 6 for the upper body 92 and/or the waist 93 of a person 9. Bands for fixing the person 9 to the hospital bed 5 are shown here. However, the holding system 6 can also be configured as an upper body and/or waist strap, harness or the like.

Figure 3:
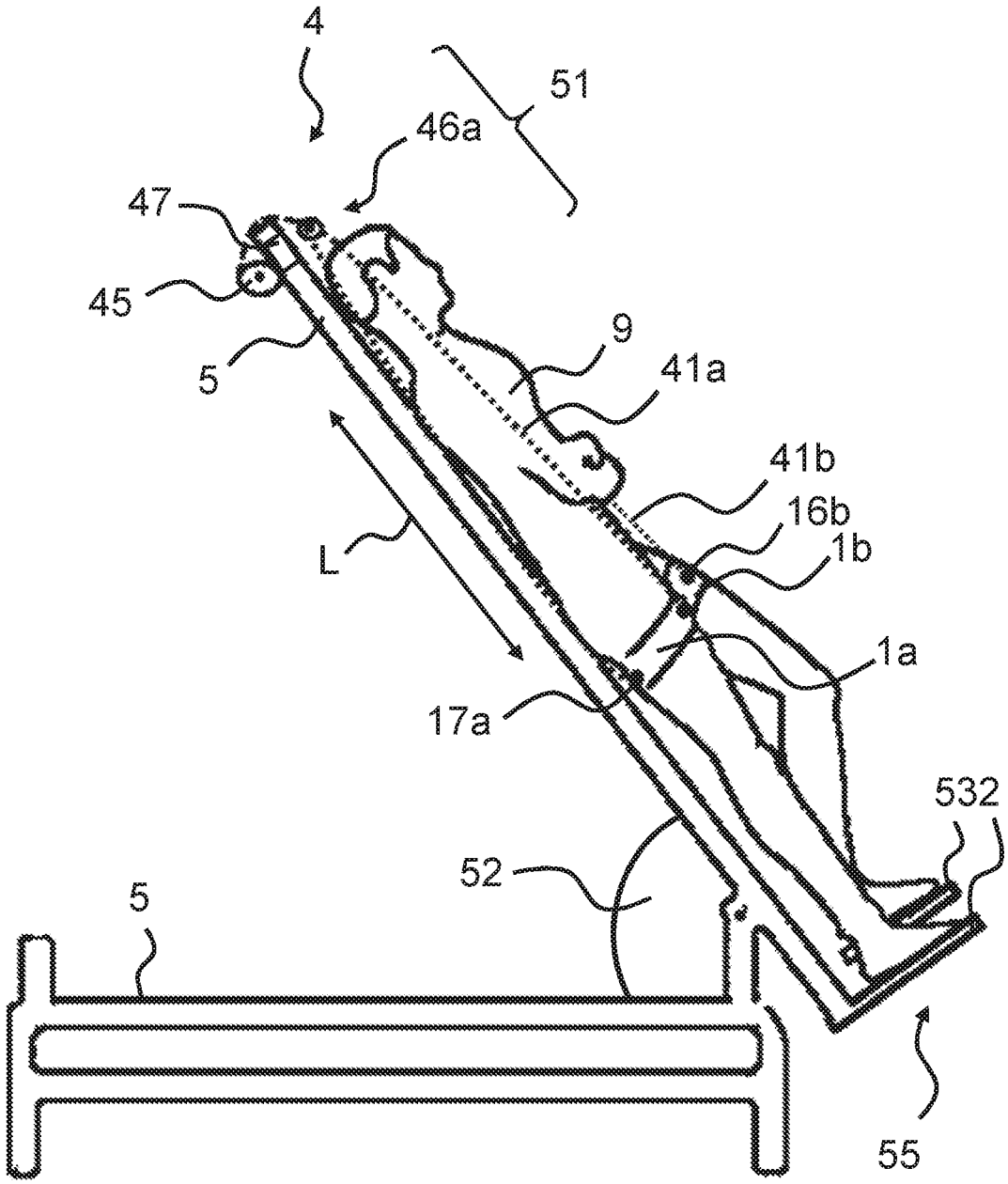
FIG. 3 shows a side view of the relief system from FIG. 1.

FIG. 3 shows a side view of the relief system 4 from FIG. 1. It will be seen that a means 45 for longitudinal displacement can be arranged at the head end 51 of the hospital bed 5 and is preferably designed to displace the suspension 44*a*, 44*b* along a longitudinal direction L, in particular of a hospital bed 5.

In addition, as is shown in FIG. 3, a sensor 47 for measuring a weight force on the person 9, in particular for measuring the force acting on the outer extremities, can be arranged at the head end 51 of the hospital bed 5 and/or at the additional means 53 for at least partially taking up further weight of the person 9, preferably at the foot module 532 of a rehabilitation mechanism 55 (cf. FIG. 1) or at a base plate 531 arranged at the foot end 54 of the hospital bed 5 (cf. FIG. 2), which sensor 47 provides control data for the control of a means 45 for longitudinal displacement, of an additional means 53 for at least partially taking up further weight of the person 9, and/or of a verticalization mechanism 52 of a hospital bed 5.

Figure 4:
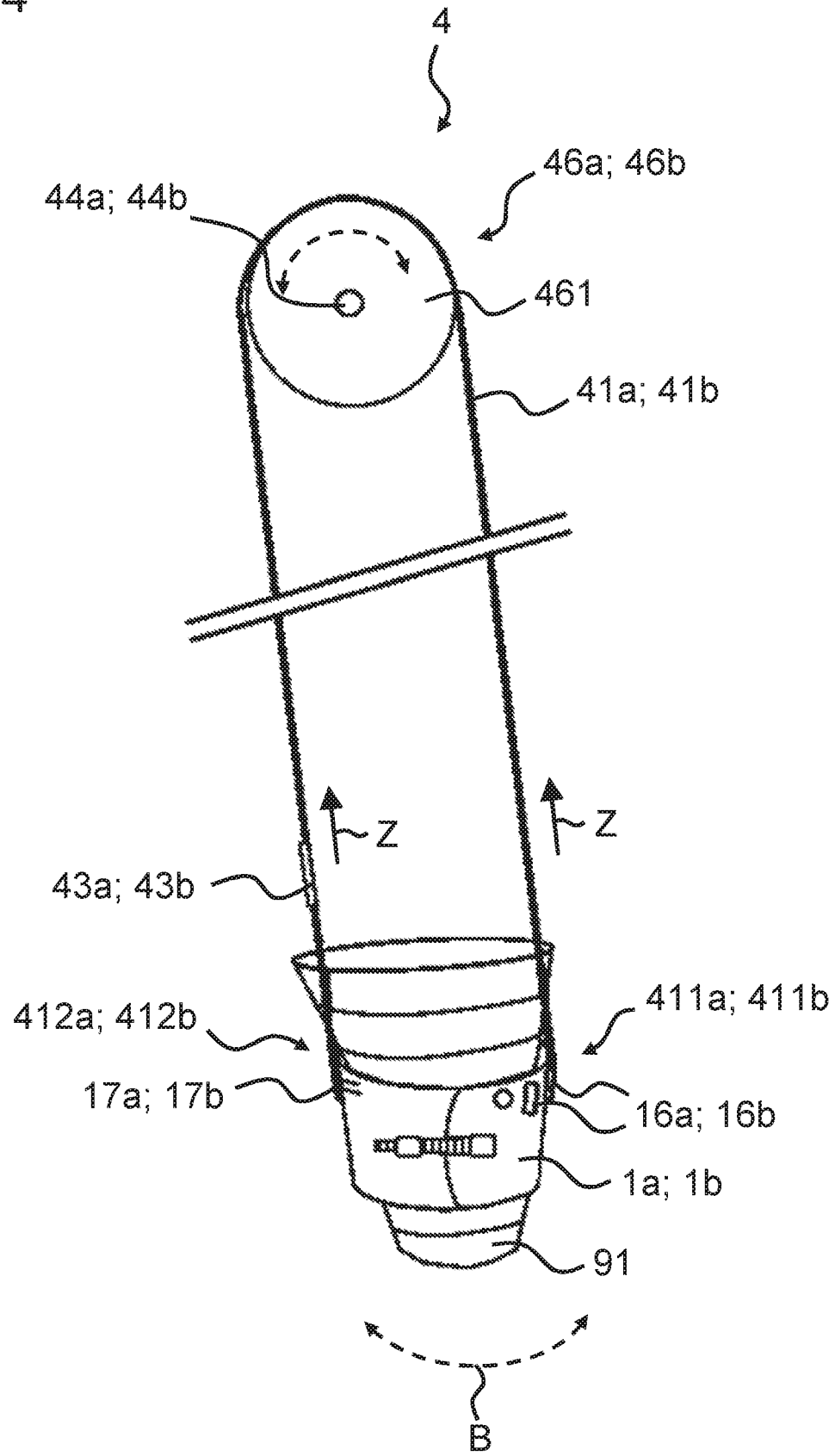
FIG. 4 shows a side view of a relief system with a suspension and with a first support means.

FIG. 4 shows a side view of a relief system 4 with a suspension 44*a*, 44*b* and with a first support means 41*a*, 41*b*. The lines cutting obliquely through the support means 41*a*, 41*b* are here intended to indicate that the figure is not shown true to scale and that the length of the support means 41*a*, 41*b* must be imagined as being longer in comparison to the dimensioning of the other structural parts shown.

At least one first fastening means 16*a*, 16*b* for fastening a first end 411*a*, 411*b* of the first support means 41*a*, 41*b* and at least one second fastening means 17*a*, 17*b* for fastening a second end 412*a*, 412*b* of the first support means 41*a*, 41*b* are formed on the cuff 1*a*, 1*b*, such that an equally distributed tensile force Z is exerted on the cuff 1*a*, 1*b* at the first fastening means 16*a*, 16*b* and second fastening means 17*a*, 17*b* when the first support means 41*a*, 41*b* is guided through the guide means 46*a*, 46*b* during a movement B of the cuff 1*a*, 1*b* when loaded by at least part of the body weight of the person 9. The movement B of the cuff 1*a*, 1*b* can be triggered here by a stepping or walking movement of the person 9 or by a movement initiated by a rehabilitation mechanism 55, in particular by the foot module 532 of the latter.

In the example shown here, the support means 41*a*, 41 *b* runs via a guide means 46*a*, 46*b* designed as a deflection roller 461 and is operatively connected with its first end 411*a*, 411 *b* to the first fastening means 16*a*, 16*b* and with its second end 412*a*, 412*b* to the second fastening means 17*a*, 17*b*.

In this way, a deflection of the tensile force from the front to the rear of the cuff 1*a*, 1*b* is effected via the deflection roller 461, as a result of which a constant relief force is generated, and the outer extremities of the person 9, in particular the legs, that are received by the cuff 1*a*, 1*b* remain able to be moved or to move.

The fastening means 16*a*, 16*b* and/or 17*a*, 17*b* can be arranged variably on a closed cuff 1*a*, 1*b*, such that, in the case of two fastening means 16*a*, 16*b* and/or 17*a*, 17*b*, these can be arranged at an angle of 180° to each other. The variable arrangement of the fastening means 16*a*, 16*b* and/or 17*a*, 17*b* can preferably be effected by rails, as shown in FIG. 4 at the second fastening means 17*a*, 17*b*, and/or by the provision of several fastening means spaced apart from each other, shown here at the first fastening means 16*a*, 16*b*.

To permit better adaptation to the dimensions of the respective user, the first support means 41*a*, 41*b* can also be designed to be longitudinally adjustable at least at one end 411*a*, 411*b* and/or 412*a* 412*b*. In FIG. 4, a means 43*a*, 43*b* for the longitudinal adjustment of the first support means 41*a*, 41*b* is shown for example near the second end 412*a*, 412*b*. The means 43*a*, 43*b* for the longitudinal adjustment can preferably be formed as a buckle, with various holes spaced apart from one another in a first support part 41*a*, 41*b* configured as a strap, or as an adjusting screw in a support means 41*a*, 41*b* configured as a chain or (steel) cable.

Figure 5:
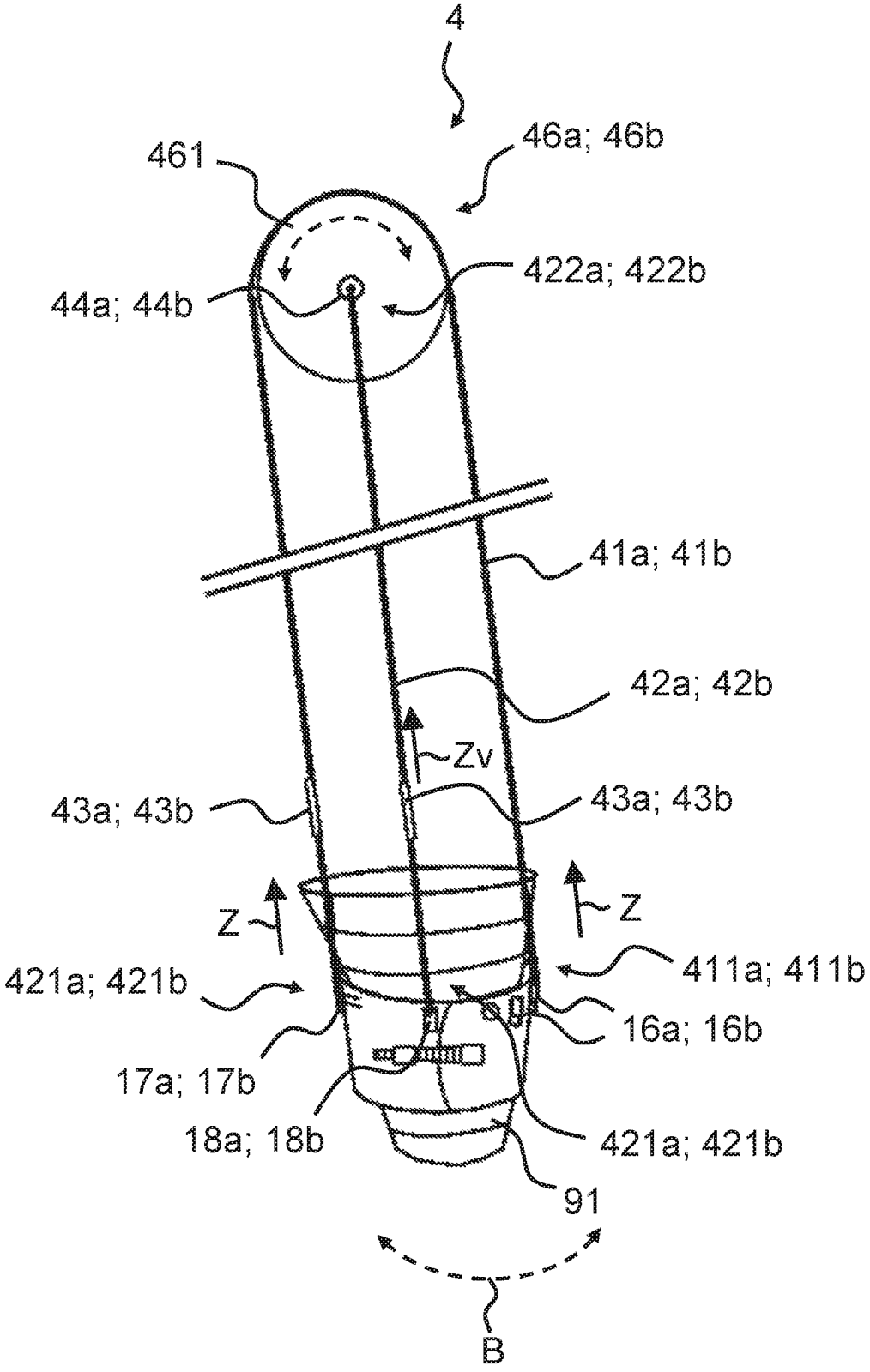
FIG. 5 shows a side view of a relief system with a suspension and with a first support means and a second support means.

Finally, FIG. 5 shows a side view of a relief system 4 with a suspension 44*a*, 44*b* and a first support means 41*a*, 41*b* and a second support means 42*a*, 42*b*. In this variant of the invention, at least one third fastening means 18*a*, 18*b* is formed on the cuff 1*a*; 1*b* for fastening a first end 421*a*, 421*b* of a second support means 42*a*, 42*b* whose second end 422*a*, 422*b* is connected to the suspension 44*a*, 44*b*, such that a variable tensile force Zv is exerted on the cuff 1*a*, 1*b* at the third fastening means 18*a*, 18*b* when the second support means 42*a*, 42*b* is guided through the guide means 46*a*, 46*b* during a movement B of the cuff 1*a*, 1*b* when loaded by at least part of the body weight of the person 9. The third fastening means 18*a*, 18*b* on a closed cuff 1*a*, 1*b* can also preferably be arranged variably such that, in the case of three fastening means 16*a*, 16*b* and 17*a*, 17*b* and 18*a*, 18*b*, these can be arranged at an angle of 120° to each other. At the zero point of the movement, i.e. with the suspended extremity of the person 9 extended and approximately straight, the force acting on the cuff 1*a*, 1*b* is in this way advantageously distributed uniformly to the cuff 1*a*, 1*b*, which advantageously increases the stability of the relief system 4, in particular as regards lateral tilting of the cuff. During a movement B of the cuff 1*a*, 1*b* in the context of a rehabilitation or mobilization exercise, the tensile force Zv on the third fastening means 18*a*, 18*b* decreases and the relief force distributes itself uniformly as tensile force Z to the first support means 41*a*, 41*b* or the first fastening means 16*a*, 16*b* and second fastening means 17*a*, 17*b*. As can be seen in FIG. 5, the second support means 42*a*, 42*b* can also be designed to be advantageously longitudinally adjustable at least at one end 421*a*, 421*b*, 422*a* or 422*b*.

The present invention relates to a relief system 4 for at least partially relieving the body weight of a person 9, characterized in that at least one first fastening means 16*a*, 16*b* for fastening a first end 411*a*, 411*b* of the first support means 41*a*, 41*b* and at least one second fastening means 17*a*, 17*b* for fastening a second end 412*a*, 412*b* of a first support means 41*a*, 41*b* are formed on a cuff 1*a*, 1*b*, such that an equally distributed tensile force Z is exerted on the cuff 1*a*, 1*b* at the first fastening means 16*a*, 16*b* and second fastening means 17*a*, 17*b* when the first support means 41*a*, 41*b* is guided through the guide means 46*a*, 46*b* during a movement B of the cuff 1*a*, 1*b* when loaded by at least part of the body weight of the person 9. It advantageously allows a bedridden patient in particular to be easily connected to the relief system 4 without said patient first of all having to be repositioned, without interfering with other medical/therapeutic devices, for example catheters and/or diagnostic sensors, and without limiting the patient in terms of a stepping/walking movement. It is of course also suitable for use in traditional rehabilitation equipment and/or sports equipment for patients not confined to bed.

LIST OF REFERENCE SIGNS

1*a*, 1*b* cuff
16*a*; 16*b* first fastening means
17*a*; 17*b* second fastening means
18*a*; 18*b* third fastening means
4 relief system for the body weight of a person (9)
41*a*; 41*b* first support means
411*a*; 411*b* first end of the first support means 41*a*; 41*b*
412*a*; 412*b* second end of the first support means 41*a*; 41*b*
42*a*; 42*b* second support means

421*a*; 421*b* first end of the second support means 42*a*; 42*b*
422*a*; 422*b* second end of the second support means 42*a*; 42*b*
43*a*; 43*b* means for longitudinal adjustment
44*a*; 44*b* suspension
45 means for longitudinal displacement
46*a*; 46*b* guide means
461 deflection roller
47 sensor
5 hospital bed
51 head end
52 verticalization mechanism
53 additional means for taking up weight
531 base plate
532 foot module
54 foot end
55 rehabilitation mechanism
6 holding system
9 person
91 thigh
92 upper body
93 waist
L longitudinal direction
Z equally distributed tensile force
Zv variable tensile force
B movement of the cuff 1*a*; 1*b*

The invention claimed is:

1. A relief system for at least partially relieving the body weight of a person, the relief system comprising:

a suspension;

a cuff for receiving at least part of a thigh of the person;

a first support device for operatively connecting said cuff to said suspension, said first support device having first and second ends;

a guide device disposed on said suspension for guiding said first support device; and at least one first fastening device formed on said cuff for fastening said first end of said first support device and at least one second fastening device formed on said cuff for fastening said second end of said first support device;

said first support device running via said guide device for exerting an equally distributed tensile force on said cuff at said first fastening device and said second fastening device upon said first support device being guided through said guide device during a movement of said cuff when loaded by at least part of the body weight of the person.

2. The relief system according to claim 1, which further comprises:

at least one third fastening device formed on said cuff; and a second support device having a first end fastened to said at least one third fastening device and a second end connected to said suspension for exerting a variable tensile force on said cuff at said at least one third fastening device upon said second support device being guided through said guide device during a movement of said cuff when loaded by at least part of the body weight of the person.

3. The relief system according to claim 2, wherein said first fastening device, said second fastening device and said at least one third fastening device are variably disposed at an angle of 120° to each other in a closed condition of said cuff.

4. The relief system according to claim 2, wherein at least one of said first support device or said second support device is at least one of a band, a belt, a strap or a chain.

5. The relief system according to claim 2, wherein at least one of said first support device or said second support device is formed of a disinfectable plastic or polyurethane or has a disinfectable or polyurethane coating.

6. The relief system according to claim 2, wherein at least one of said first support device or said second support device is longitudinally adjustable at least at one end.

7. The relief system according to claim 2, wherein said guide device has at least one slide eyelet or a deflection roller to which said first support device is operatively connected.

8. The relief system according to claim 2, wherein said suspension is part of a head end of a hospital bed configured to be in a fixed position or of a hospital bed configured to be raised to a vertical position.

9. The relief system according to claim 2, which further comprises a device for longitudinal displacement configured to displace said suspension along a longitudinal direction or along a longitudinal direction of a hospital bed.

10. The relief system according to claim 2, which further comprises an additional device for at least partially taking up further weight of the person.

11. The relief system according to claim 2, which further comprises:

at least one of a device for longitudinal displacement, an additional device for at least partially taking up further weight of the person or a verticalization mechanism of a hospital bed; and a sensor for measuring a weight force on the person or for measuring a force acting on outer extremities of the person, said sensor providing control data for controlling at least one of said device for longitudinal displacement, said additional device or said a verticalization mechanism.

12. The relief system according to claim 2, wherein:

said suspension is one of two suspensions spaced apart from each other or spaced apart from each other at a head end of a hospital bed;

said cuff is one of two cuffs; and said first support device is one of two first support devices each operatively connecting a respective one of said cuffs to a respective one of said suspensions.

13. The relief system according to claim 2, which further comprises a holding system for at least one of the upper body or the waist of a person.

14. The relief system according to claim 1, wherein said first fastening device and said second fastening device are variably disposed at an angle of 180° to each other in a closed condition of said cuff.

15. The relief system according to claim 1, wherein said guide device has at least one slide eyelet or a deflection roller to which said first support device is operatively connected.

16. The relief system according to claim 1, wherein said suspension is part of a head end of a hospital bed configured to be in a fixed position or of a hospital bed configured to be raised to a vertical position.

17. The relief system according to claim 1, which further comprises a device for longitudinal displacement configured to displace said suspension along a longitudinal direction or along a longitudinal direction of a hospital bed.

18. The relief system according to claim 1, which further comprises an additional device for at least partially taking up further weight of the person.

19. The relief system according to claim 18, wherein said additional device is a base plate disposed at a foot end of a hospital bed or a foot module of a rehabilitation mechanism.

20. The relief system according to claim 1, which further comprises:

at least one of a device for longitudinal displacement, an additional device for at least partially taking up further weight of the person or a verticalization mechanism of a hospital bed; and a sensor for measuring a weight force on the person or for measuring a force acting on outer extremities of the person, said sensor providing control data for controlling at least one of said device for longitudinal displacement, said additional device or said a verticalization mechanism.

21. The relief system according to claim 1, wherein:

said suspension is one of two suspensions spaced apart from each other or spaced apart from each other at a head end of a hospital bed;

said cuff is one of two cuffs; and said first support device is one of two first support devices each operatively connecting a respective one of said cuffs to a respective one of said suspensions.

22. The relief system according to claim 1, which further comprises a holding system for at least one of the upper body or the waist of a person.

* * * * *